US006902295B2

(12) United States Patent
Galvez

(10) Patent No.: US 6,902,295 B2
(45) Date of Patent: Jun. 7, 2005

(54) DROP-LIGHT APPARATUS

(75) Inventor: James M. Galvez, San Dimas, CA (US)

(73) Assignee: National Electric Manufacturing, Commerce, CA (US)

( * ) Notice: Subject to any disclaimer, the term of this patent is extended or adjusted under 35 U.S.C. 154(b) by 0 days.

(21) Appl. No.: 10/438,430

(22) Filed: May 15, 2003

(65) Prior Publication Data

US 2004/0228125 A1 Nov. 18, 2004

(51) Int. Cl.[7] ..... F21V 23/02; F21V 15/04

(52) U.S. Cl. ..... 362/222; 362/225; 362/390; 362/394

(58) Field of Search ..... 362/216, 217, 362/220–225, 260, 306, 369, 390, 394

(56) References Cited

U.S. PATENT DOCUMENTS

| | | | | | |
|---|---|---|---|---|---|
| 4,583,154 | A | * | 4/1986 | Haller | 362/222 |
| 5,117,345 | A | * | 5/1992 | Baake | 362/390 |
| 5,436,815 | A | * | 7/1995 | Grooms et al. | 362/216 |
| 5,465,196 | A | * | 11/1995 | Hasenberg et al. | 362/223 |
| 5,860,730 | A | * | 1/1999 | Hesprich | 362/260 |
| 6,663,265 | B2 | * | 12/2003 | Kovacik et al. | 362/225 |
| 6,727,664 | B2 | * | 4/2004 | Miller et al. | 362/223 |

* cited by examiner

*Primary Examiner*—Alan Cariaso
(74) *Attorney, Agent, or Firm*—William W. Haefliger

(57) ABSTRACT

An illumination device comprising, in combination an elongated housing, at least two elongated lamps extending in the housing, one or two magnetic ballasts carried in the housing to selectively energize the lamp or lamps, and switch means carried by the housing to control energization of said one or two ballasts.

11 Claims, 4 Drawing Sheets

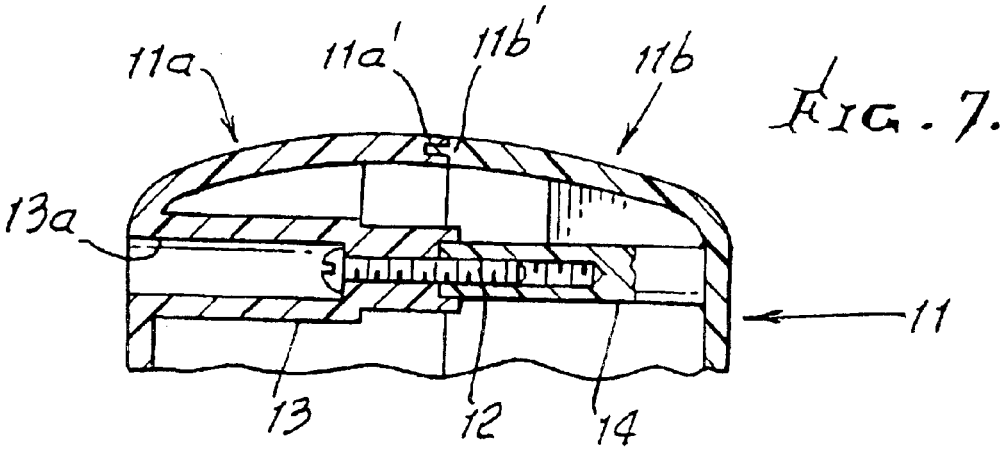
FIG. 7.
FIG. 8.
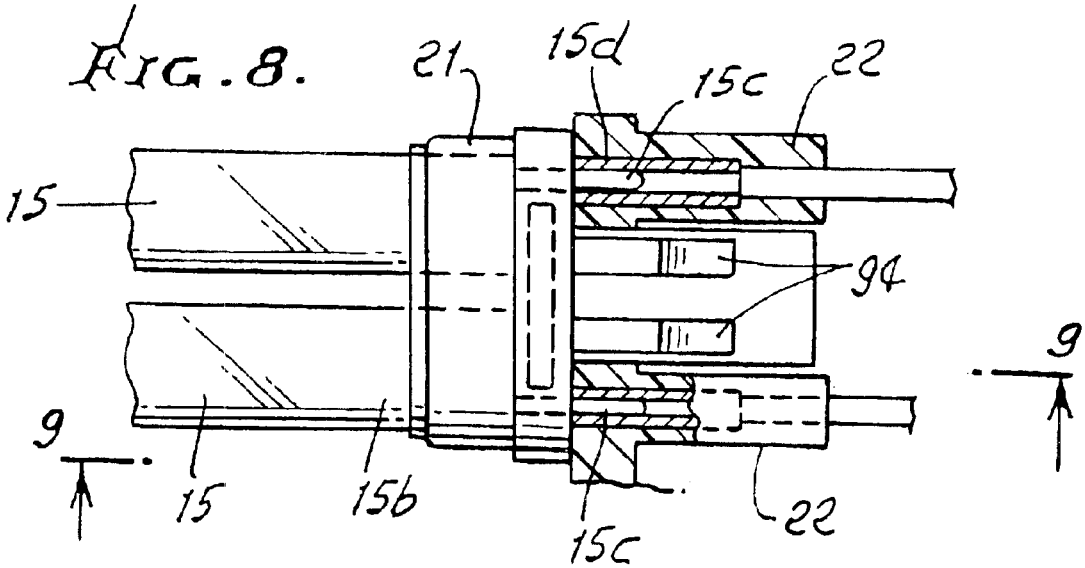
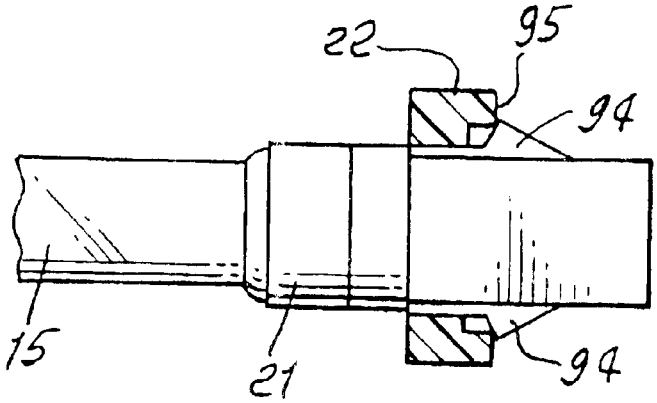
FIG. 9.

DROP-LIGHT APPARATUS

BACKGROUND OF THE INVENTION

This invention relates generally to portable illumination devices and more particularly to an improved device wherein a bulb or lamp, or lamps, are energized by magnetic ballast or ballasts.

There is need for improvements in portable illumination devices wherein complexity of electrical circuitry required for power supply to lamps is reduced, and wherein unreliability of such power supply is also reduced. There is also need for an improved device employing magnetic ballast or ballasts, as well as a device having improvements in structure and functions as will be seen.

SUMMARY OF THE INVENTION

It is a major object of the invention to provide for improvements in portable illumination devices as referred to. Basically, the device comprises:

a) an elongated housing, b) at least two elongated lamps extending in the housing, c) one or preferably two magnetic ballasts carried in the housing to selectively energize the lamps, d) and switch means carried by the housing to control energization of said one or two ballasts.

As will be seen, the housing typically has a forward illumination portion, a rearward grip portion and an intermediate portion, and wherein the lamp or lamps are carried at said forward portion, one of said two magnetic ballasts is carried at said intermediate portion, and the other of said two ballasts is carried at said rearward portion, enhancing weight distribution and ease of handling. Magnetic ballasts are significant weight adding devices, and their separation adds to manual control. One ballast may control one lamp, and the other ballast may control a second lamp, whereby at least one lamp will remain energized by a ballast if the other ballast fails. The lamps are typically fluorescent.

Another object is to provide improved cushioning supports for the multiple, elongated, parallel lamps.

Yet another object comprises optimum positioning of two ballasts in separate housing sections for weight distribution, and for hand gripping close to the magnetic ballasts. In this regard, ballast edge locating elements are provided in the housing sections, and may be molded into plastic housing shell sections.

An added object is to locate the ballasts out of the reflected light transmission path or paths from the lamps, as will be seen.

These and other objects and advantages of the invention, as well as the details of an illustrative embodiment, will be more fully understood from the following specification and drawings, in which:

DRAWING DESCRIPTION

FIG. 7 is a section taken on lines 7—7 of FIG. 3;

FIG. 8 is an enlarged plan view showing the lamps terminal and socket assembly;

FIG. 9 is a view taken on lines 9—9 of FIG. 8.

DETAILED DESCRIPTION

Figure 1:
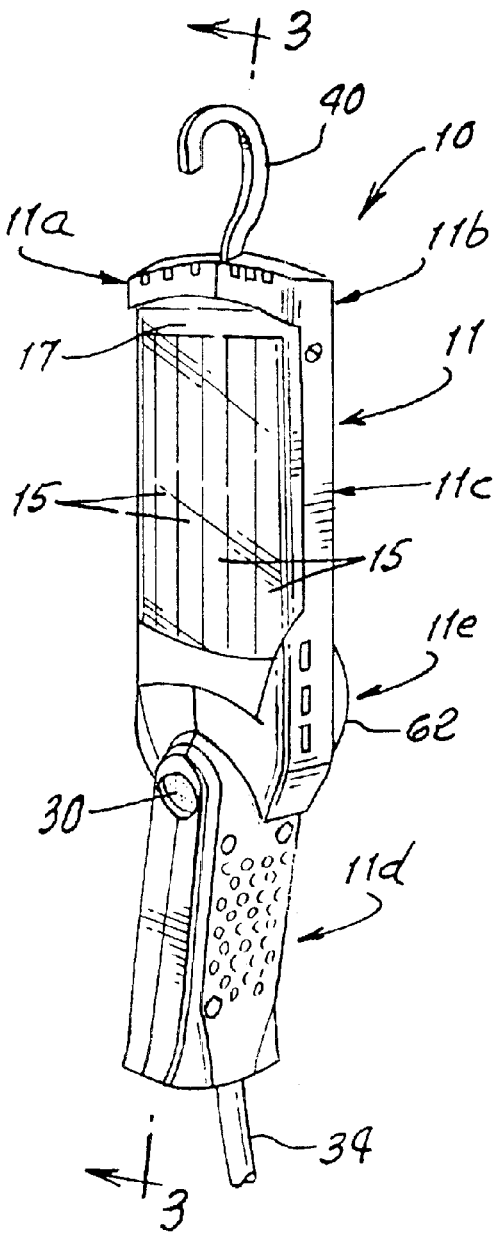
FIG. 1 is an elevation view, in perspective, showing the front side of the illumination device.
Figure 2:
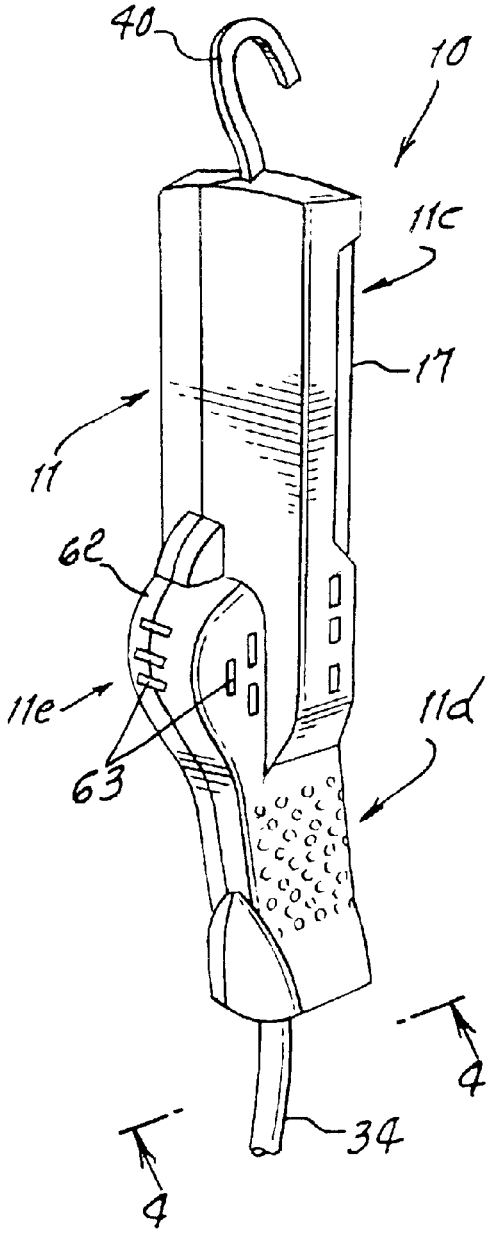
FIG. 2 is a view like FIG. 1, but showing the rear side of the device.

The preferred illumination device 10 includes an elongated housing 11 which may consist of two complementary molded plastic shell sections 11*a* and 11*b*, each extending throughout the length of the housing. Screw fasteners 12 hold the sections together, as for example is indicated in FIG. 7. A screw 12 interconnects two posts 13 and 14 respectively molded in and to sections 11*a* and 11*b*. The screw head is typically protectively received in a recess 13*a* of post 13. Section edges 11*a*' and 11*b*' are held together as shown. Other means to interconnect the sections may be provided.

Figure 6:
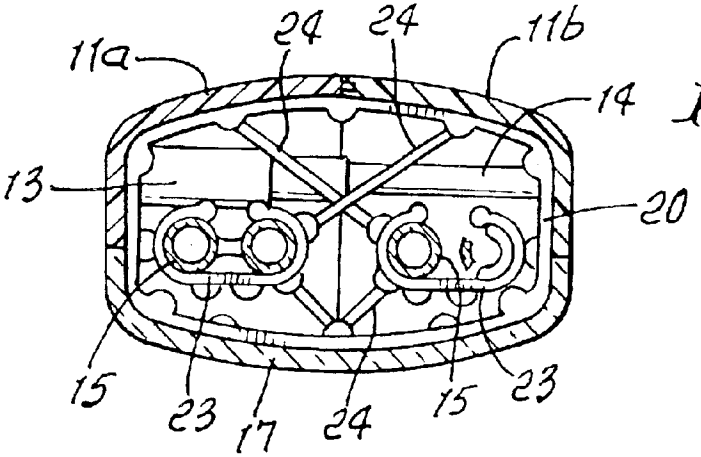
FIG. 6 is a section taken on lines 6—6 of FIG. 3.

The two sections of the housing together define a housing forward illumination portion 11*c*, a rearward grip portion 11*d*, and an intermediate portion 11*e*. At least two elongated lamps 15 are carried to extend endwise in the hollow interior 16 of the housing forward portion 11*c*, and so as to face a window or lens 17 peripherally carried by the housing sections 11*a* and 11*b*, as is also clear form FIG. 1 . Two such lamps 15 are shown in FIG. 6, each having two adjacent sections. For example, each lamp may be H-shaped or U-shaped, extending in parallel relation in a common plane, and substantially filling, widthwise, the interiors defined by the two housing sections, for maximum light transmission in the sideward direction indicated by arrow 18 in FIG. 3, and through lens 17. A reflector 19 is provided at the sides of the lamps opposite the lens, and may consist of a reflecting paper or other material.

Figure 3:
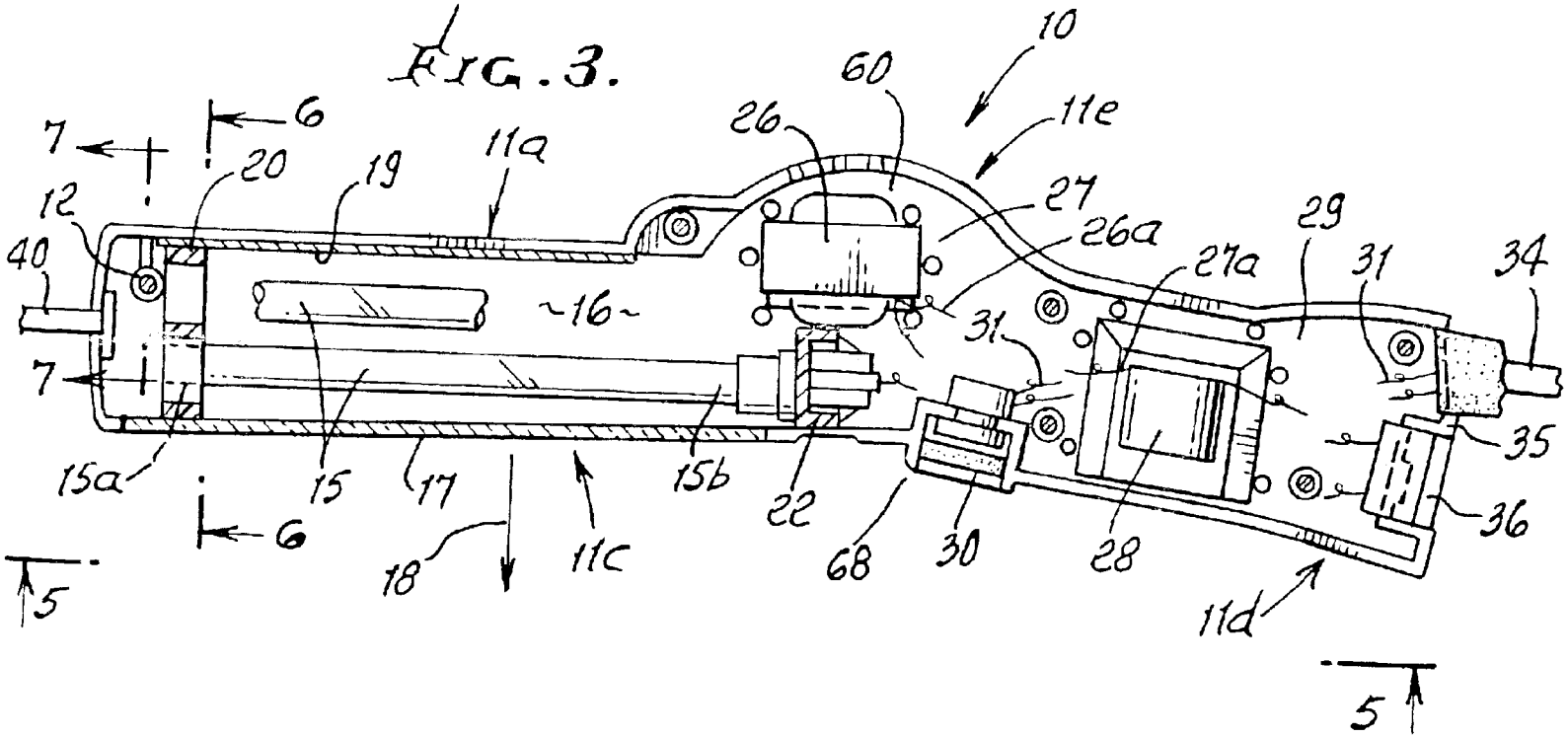
FIG. 3 is an enlarged section taken on lines 3—3 of FIG. 1.
Figure 4:
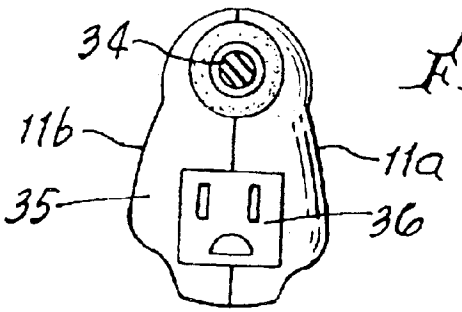
FIG. 4 is a bottom plan view taken on lines 4—4 of FIG. 2.
Figure 5:
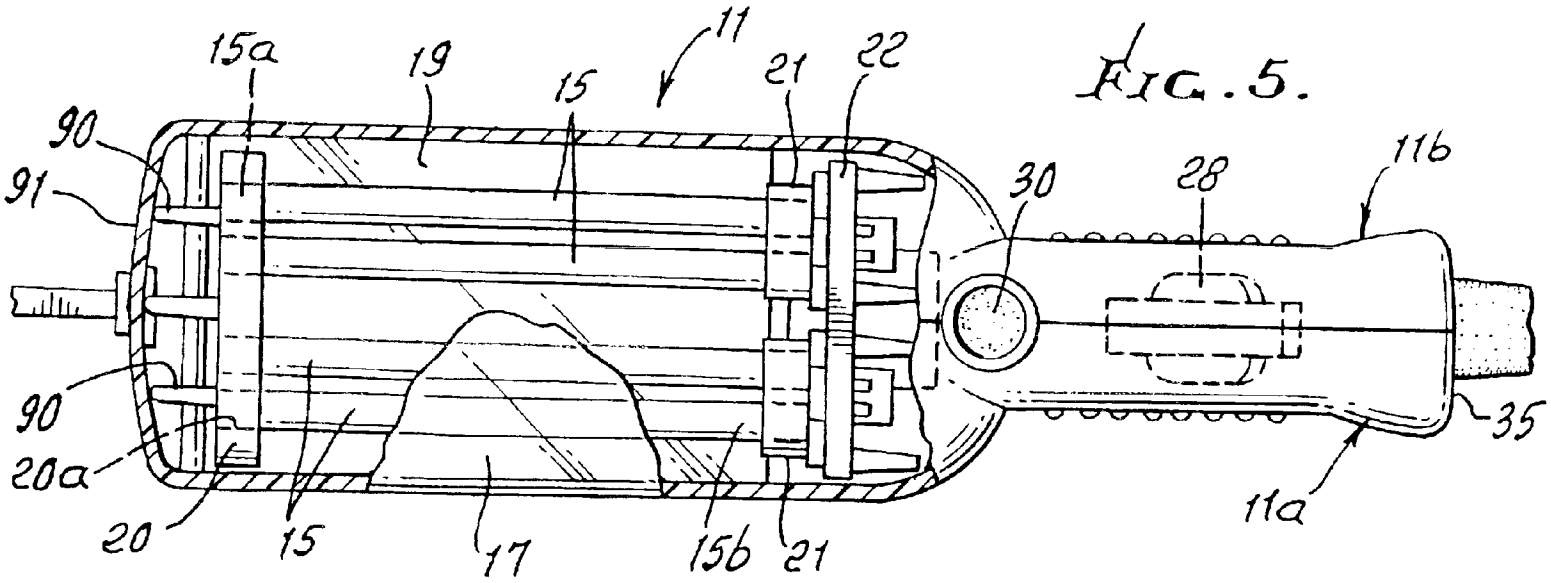
FIG. 5 is a frontal view, taken on line 5—5 of FIG. 3, and partly broken away to show interior construction.

The lamps 15 have distal end portions 15*a* received in openings 20*a* in cushioning holder or holders 20 that endwise seat the lamps. Such holder or holders may consist of elastomeric material, such as rubber or molded plastic, carried by the housing forward portion as seen in FIG. 3. Spikes 90 carried by holder 20 project toward end walls 91 of the housing, to position the holder and lamp ends, endwise. The opposite end portions 15*b* of the lamps are carried by a plug or plugs 21 as seen in FIG. 8, and have electrical terminal pins 15*c* projecting into electrical sockets 15*d* carried within elastomeric holder or holders 22. Mounting holders or clips are shown at 23 in FIG. 6, there being two U-shaped holders or clips 23, each carrying two of the lamp end portions, or their holders. Note in FIG. 6 the web structure 24 formed in the housing interior and positioning the two holders or clips 23, within 22. Spikes 94 on 22 project toward housing wall 95 to position holder 22.

Also provided are at least one, and preferably two magnetic ballasts carried in the housing to energize the lamp or lamps, which are typically fluorescent. Two such ballasts are shown, one indicated at 26 within the hollow interiors 27 of the housing sections at the intermediate portion 11*e* of the housing, and the other indicated at 28 within the hollow interiors 29 of the housing sections and inwardly of the rearward grip portion 11*d* of the housing for ease of handling. One ballast is shown as electrically connected to one lamp associated with one holder or clip 23; and the other ballast is shown as electrically connected to the other lamp associated with the other holder or clip 23. See wiring at 26*a* and at 27*a*. Each lamp is typically U-shaped, or H-shaped to assemble to holder or holders 20 and 22. This enables power supply to both lamps, and if one ballast fails to operate for any reason, the other ballast remains operative to supply power to its associated lamp.

An ON-OFF switch 30 in series with an AC power supply line 31 controls ON-OFF power supply to the two ballasts. The cable or cord for line 31 is shown as connecting at 34 to the end 35 of the grip portion 1*d* of the housing. An auxiliary power receptacle 36 is also provided at the housing end 35 to supply power from line 31 to a plug that may be inserted into receptacle 36, as for power supply to another similar illumination device, if desired, or to other equipment. A hook 40 is carried at the forward end of the device to hang or support the device, from other structure, as at a work place.

It will be noted that the two ballasts are separated, for weight distribution along the length of the device 10, and for weight concentration toward the manual grip end of the device, facilitating case of transport and maneuver of the device. Ballast 26 is located within a domed interior 60 of the housing, covered by housing device 62, vented at 63.

Ballasts of the type shown are known, one example being Models 013 and 015, produced by Robertson Ballast Company, of Chicago, Ill.

In a typical example, the device incorporates two 13-watt lamps, which withstand heavy usage and frequent device drops. The lamps may provide 26 watts of light energy, which is equivalent to 120+ watts of incandescence, so that an entire large work area can be illuminated. The body or housing is made of the durable plastic material. The ratcheting or detent hanging hook directs light to where needed, and the heavy duty (for example 3 conductor) cord withstands all normal shop usage. The unique push button switch prevents accidental on/off operation when working, as it is located in a shallow V-shaped recess 68 defined by the housing. Housing portion 11*d* is angled at between about 5° and 15° relative to housing portion 11*c*, thereby creating recess 68.

One example of the above lamp or lamps is known as PL-13 size lamp.

I claim:

1. An illumination device comprising, in combination:

a) an elongated housing, b) at least two elongated lamps extending in the housing, c) two magnetic ballasts carried in the housing to selectively energize the lamps, d) and switch means carried by the housing to control energization of said two ballasts, e) said housing having a forward illumination portion, a rearward grip portion and an intermediate portion, and wherein the lamps are carried at said forward portion, one of said two ballasts being carried at said intermediate portion, and the other of said two ballasts being carried at said rearward portion.

2. The combination of claim 1 wherein said two lamps have distal end portions, there being cushioning means carried by the housing, and carrying said lamp distal end portions.

3. The combination of claim 1 including cushioning means carrying lamp end portions, said cushioning means comprising an elastomer.

4. The combination of claim 3 wherein said elastomer defines a holder or holders peripherally carried by two sections of the housing.

5. The combination of claim 1 wherein the housing defines a side opening, there being a solid transparent window at said side opening and facing said two lamps.

6. The combination of claim 1 wherein the housing defines a side opening, there being a solid transparent window at said side opening and facing said two lamps, and there being a reflector at the side of the lamps opposite said window.

7. The combination of claim 1 wherein said switch means includes a push button at a side of said intermediate portion of the housing which defines a shallow V-shaped recess.

8. The combination of claim 6 wherein said switch means includes a push button at a side of said intermediate portion of the housing, and wherein said push button is at the same side of the housing as said switch means.

9. The combination of claim 1 wherein said lamps are fluorescent lamps.

10. The combination of claim 1 including edge locating elements in two sections of the housing, for positioning said ballasts.

11. The combination of claim 10 including lamp holders at opposite ends of the lamps, and spikes on the holders engageable with housing walls to position the lamps endwise in the housing, and in spaced relation to the one or two ballasts.

* * * * *